US008186126B2

(12) United States Patent
Vultaggio

(10) Patent No.: US 8,186,126 B2
(45) Date of Patent: May 29, 2012

(54) SITE-ASSEMBLED POOL AND METHOD OF ASSEMBLY

(76) Inventor: Richard Vultaggio, Vestal, NY (US)

( * ) Notice: Subject to any disclaimer, the term of this patent is extended or adjusted under 35 U.S.C. 154(b) by 416 days.

(21) Appl. No.: 12/397,749

(22) Filed: Mar. 4, 2009

(65) Prior Publication Data

US 2009/0165201 A1 Jul. 2, 2009

Related U.S. Application Data

(63) Continuation-in-part of application No. 10/919,127, filed on Aug. 16, 2004, now Pat. No. 7,716,756.

(51) Int. Cl.
*E02D 27/00* (2006.01)

(52) U.S. Cl. ..... 52/741.11; 52/126.1; 52/DIG. 1; 52/749.1

(58) Field of Classification Search ..... 52/741.11, 52/749.1, 749.11, 750, 126.1, DIG. 1; 4/506; 33/1 H, 1 G, 27.03, 333, 334, 451, 375, 521, 33/533

See application file for complete search history.

(56) References Cited

U.S. PATENT DOCUMENTS

| | | | | |
|---|---|---|---|---|
| 2,520,700 | A * | 8/1950 | Thorndike | 33/375 |
| 2,743,528 | A * | 5/1956 | Posthauer, Sr. | 33/375 |
| 2,746,164 | A * | 5/1956 | Eitzen | 33/375 |
| 2,934,180 | A | 4/1960 | Hammitt et al. | |
| 4,397,441 | A | 8/1983 | Manderla | |
| 4,599,835 | A | 7/1986 | Rinke | |
| 4,736,641 | A | 4/1988 | Reid | |
| 4,974,266 | A | 12/1990 | Vultaggio et al. | |
| 5,878,502 | A * | 3/1999 | Donahue, Jr. | 33/374 |
| 6,367,099 | B1 | 4/2002 | Contrino et al. | |
| 6,412,122 | B1 | 7/2002 | Foy et al. | |
| 6,729,097 | B2 | 5/2004 | Patel et al. | |
| 2006/0070249 | A1 * | 4/2006 | Wallach et al. | 33/1 G |

OTHER PUBLICATIONS http://www.poolsaboveground.com/pool-information/pool-build-installation.php, 2004-2009.

"Round Pool Installation Guide" available at http://web.archive.org/web/20061105021219/http://www.crestwoodpools.com/_images/uploaded_docs/round_pool_guide.pdf, Nov. 2006.

* cited by examiner

*Primary Examiner* — William Gilbert
*Assistant Examiner* — Beth Stephan
(74) *Attorney, Agent, or Firm* — Brown & Michaels, PC

(57) ABSTRACT

A site-assembled enclosure of the present invention includes a plurality of upstanding staves arranged side-by-side and held together by top and bottom rails. The enclosure is preferably a pool including a coping extending entirely around and in releasably secured relation to the rails that fasten the upper ends of the staves together and a flexible liner and cover releasably secured to the coping. The wooden staves include opposing vertical edges interconnecting the two staves. The leveling gauge for leveling a construction area preferably includes a threaded rod, a pivot bracket rotatably mounted on the threaded rod, a board extending from the pivot bracket, and a level mounted on the board. A method of assembling an enclosure is also described.

17 Claims, 13 Drawing Sheets

SITE-ASSEMBLED POOL AND METHOD OF ASSEMBLY

REFERENCE TO RELATED APPLICATIONS

This is a continuation-in-part patent application of co-pending application Ser. No. 10/919,127, filed Aug. 16, 2004, entitled "SITE ASSEMBLED POOL". The aforementioned application is hereby incorporated herein by reference.

BACKGROUND OF THE INVENTION

1. Field of the Invention

The invention pertains to the field of construction. More particularly, the invention pertains to an enclosure, a tool for ground leveling, and a method of construction.

2. Description of Related Art

U.S. Pat. No. 4,974,266 describes a site-assembled swimming pool structure including a flexible liner supported by a surrounding wall of side-by-side wooden staves, where one vertical edge of each stave is convex and the other edge is concave. When the staves are arranged in side-by-side relation, the convex edge of one stave nests in the concave edge of the adjacent stave. A plurality of cables pass entirely around the wall, and the cables are tensioned to urge the staves into a tightly engaged relationship. A downwardly facing U-shaped track member extends around the upper periphery of the wall and snugly engages the upper ends of the staves. The track member includes open channels formed on its opposing sides for releasably receiving bead portions of the pool liner in the inwardly facing channel and a removable cover in the outwardly facing channel.

SUMMARY OF THE INVENTION

A site-assembled enclosure of the present invention includes a plurality of upstanding staves arranged side-by-side and held together by top and bottom rails. The enclosure is preferably a pool including a coping extending entirely around and in releasably secured relation to the rails that fasten the upper ends of the staves together and a flexible liner and cover releasably secured to the coping. The wooden staves include opposing vertical edges interconnecting the two staves. The leveling gauge for leveling a construction area preferably includes a threaded rod, a pivot bracket rotatably mounted on the threaded rod, a board extending from the pivot bracket, and a level mounted on the board. A method of assembling an enclosure is also described.

In one embodiment, a site-assembled enclosure includes a plurality of panels, a plurality of bottom fasteners, and a plurality of top fasteners. Each panel includes a plurality of staves, a top rail, and a bottom rail. The staves are arranged side-by-side with each stave having top and bottom ends, inwardly and outwardly facing major surfaces, and first and second opposing side edges extending between the major surfaces. Each top rail includes a top stave-retaining portion that maintains the upper ends of the staves, a first top projecting portion extending from a first end of the panel, and a second top projecting portion extending from a second end of the panel opposite the first end. Each bottom rail includes a bottom stave-retaining portion that supports the lower ends of the staves, a first bottom projecting portion extending from the first end of the panel, and a second bottom projecting portion extending from the second end of the panel. Each top fastener connects the first top projecting portion of a panel to the second top projecting portion of a neighboring panel. Each bottom fastener connects the first bottom projecting portion of a panel to the second bottom projecting portion of a neighboring panel. The panels are fastened to each other at predetermined angles to form the enclosure.

In another embodiment, a leveling gauge includes a threaded rod, a pivot bracket, and at least one nut. The pivot bracket includes a center portion, an upper portion extending outward from a first side of the center portion at an upper end, and a lower portion extending outward from the first side of the center portion at a lower end. The lower portion has at least one fastener hole for receiving a fastener and a round hole sized to fit slidingly over the threaded rod. The upper portion has at least one fastener hole for receiving a fastener and an oval hole having a short dimension sized to fit slidingly over the threaded rod. The round hole and the oval hole are in alignment. The nut is adjustably threadable on the threaded rod for supporting the lower portion of the pivot bracket on the threaded rod such that the pivot bracket is pivotable around the threaded rod.

In yet another embodiment, a method of construction includes the step of using a leveling gauge. The leveling gauge includes a threaded rod mounted vertically in the ground, a pivot bracket rotatably mounted on the threaded rod, a horizontal board mounted in the pivot bracket, and a level mounted on a top planar surface of the horizontal board to measure a dig radius of an area to be leveled. This method also includes the step of marking the ground at a dig radius distance from the threaded rod as measured using the horizontal board.

DETAILED DESCRIPTION OF THE INVENTION

Figure 1:
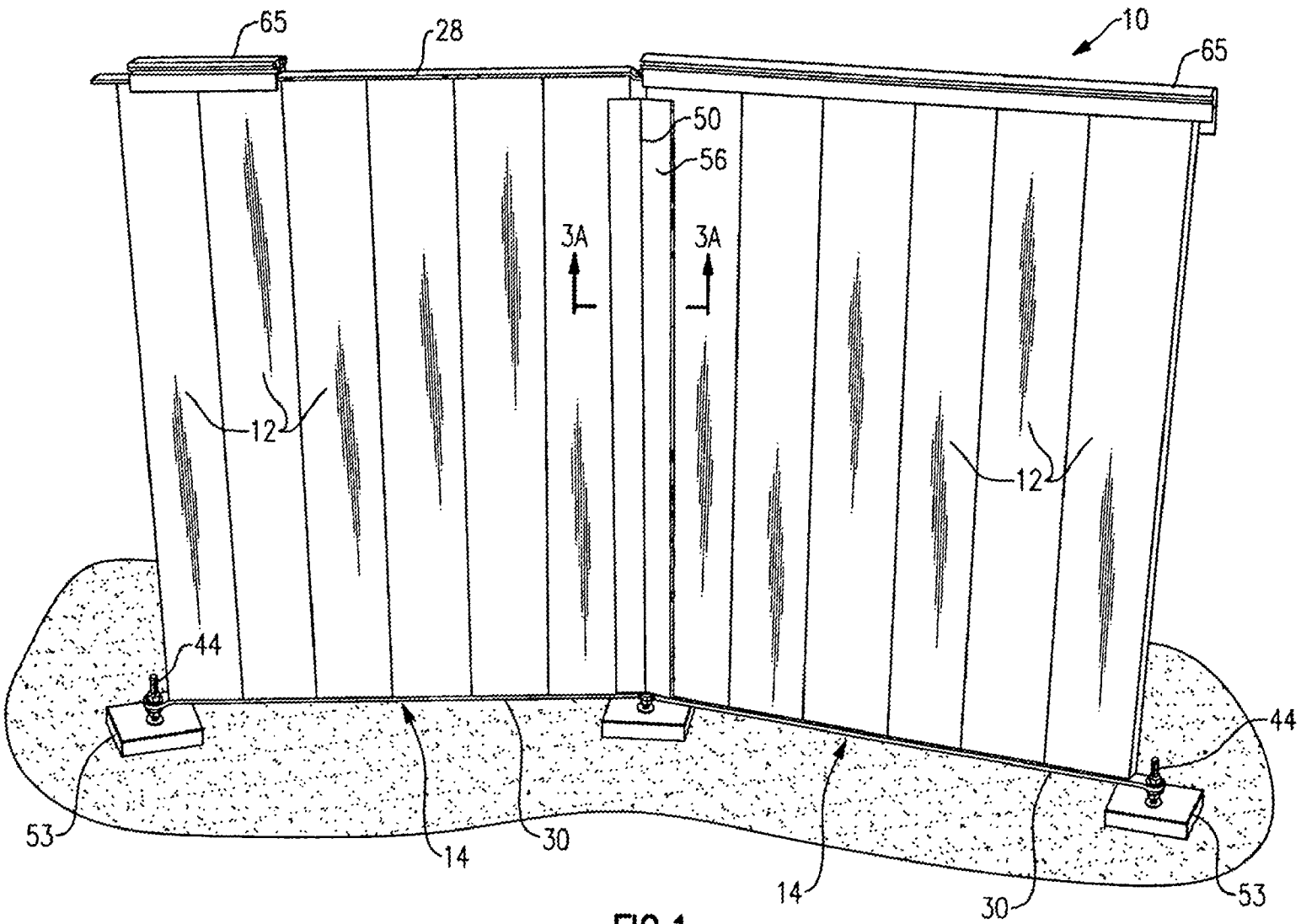
FIG. 1 shows an interior perspective view of a portion of the support walls of a pool in an embodiment of the present invention.
Figure 2:
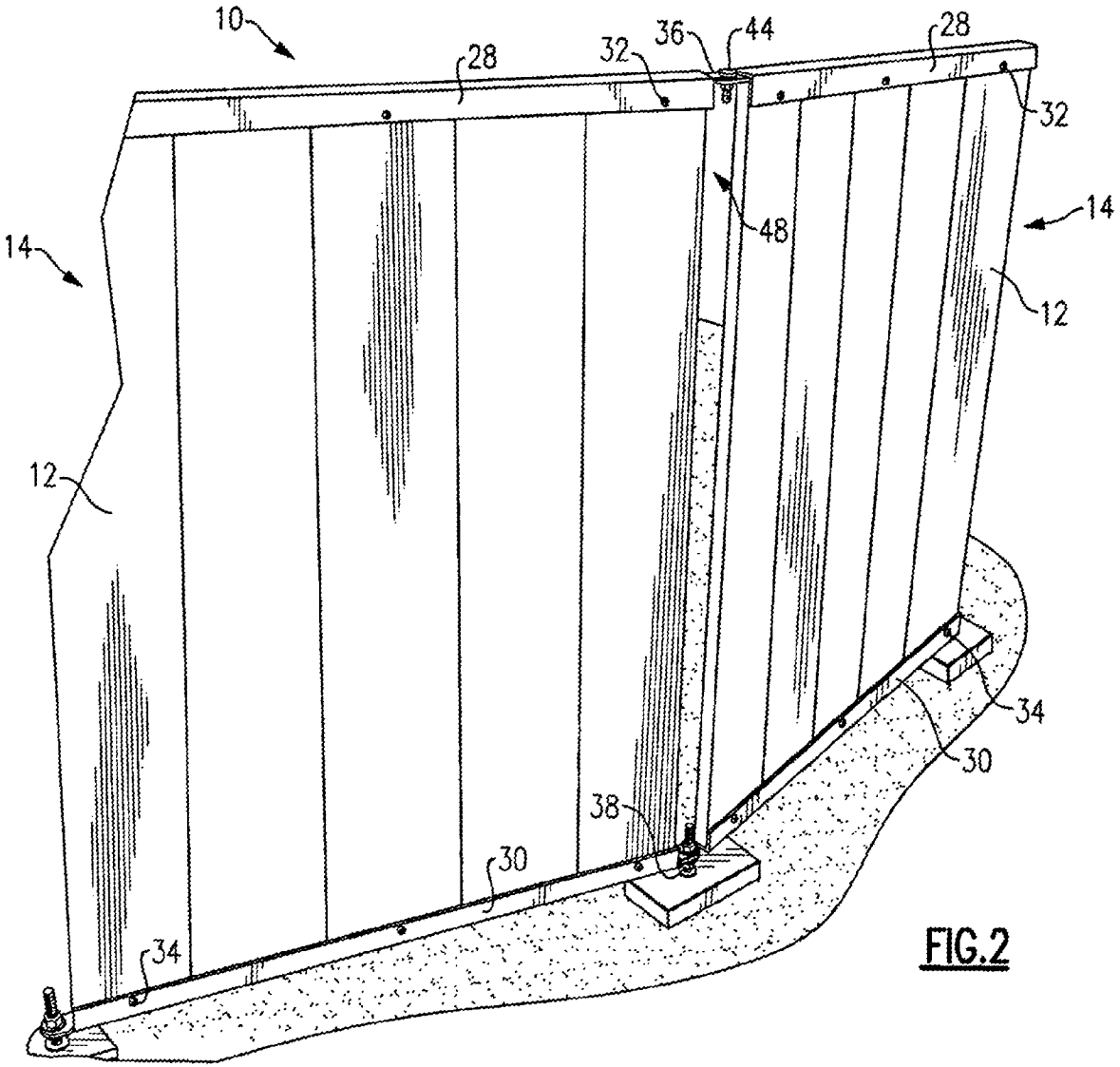
FIG. 2 shows an exterior perspective view of the support walls of FIG. 1.

Although an enclosure of the present invention is described as a swimming pool, the enclosure may be any type of enclosure with walls including, but not limited to, an above-ground swimming pool, a semi-in-ground swimming pool, an in-ground swimming pool, a whirlpool, or a yurt. A site-assembled pool preferably includes a plurality of upstanding staves arranged side-by-side, a coping extending entirely around and in releasably secured relation to the rails that fasten the upper ends of the staves together, and a flexible liner and a cover releasably secured to the coping. The wooden staves include opposing vertical edges, which are preferably a modified tongue and a groove. When assembled, the tongue of one stave engages the groove of the adjacent stave, thereby interconnecting the two staves. Preferably, a predetermined number of staves are interconnected to one another to form a panel. Each panel is preferably rigid, with neighboring staves being held in a fixed predetermined relationship determined by the form of the rails along the upper and lower ends of the panels. The panels are connected to form an enclosure. The enclosure may have any predetermined shape including, but not limited to, oval, rectangular, or circular. The size and shape of a pool constructed in accordance with the present invention is predetermined by the size of the panels used to construct the pool, the number of panels, and the angles between the panels, as shown by the examples in Table 1 below. The panels are interconnected to one another with rails and bolts to form an enclosure. A flexible joint cover is preferably inserted between adjacent panels to provide closure to the wall formed by the panels. To provide effective sealing and to avoid pinching the liner between adjacent panels, the gaps between panels are preferably filed by joint covers. In one embodiment the joint cover includes a medial portion extending between the adjacent panels, an outer face that is positioned in contacting relation to the outwardly facing surface of the panels, and an inner face that is positioned in contacting relation to the inwardly facing surface of the panels. Other embodiments of joint covers are also described, including joint covers with only an inner part to cover the inside surface of the gap.

Rails, preferably made of metal, extend along the upper and lower ends of the panels and include portions that extend beyond the side edges of the end staves. The staves are preferably securely affixed to the rails via fasteners, such as screws or nails, that pass through the rails and penetrate into the staves. The extension portions include through-holes that permit passage of a fastener, and the extension portions of rails mounted on adjacent panels are positioned such that the holes formed through the respective extensions axially align with one another. A bolt may then be placed through the aligned holes and fastened with a nut, thereby securely interconnecting adjacent panels. The bottom bolt preferably permits vertical adjustments to be made to the rails, and hence to the panels, thereby permitting leveling of the panels as the pool is constructed.

Once adjacent panels are securely interconnected, the flexible joint cover is inserted between the end staves. A generally U-shaped coping is then preferably positioned on the upper edge of the upper rail member. The coping includes a pair of legs with a space between them. The space is engaged by the outside edge/upper edges of the rail and securely interconnects the coping to the upper rail and panels. A channel is formed in the inwardly facing wall of the coping that is adapted to receive the bead portion of a flexible pool liner. A flange formed in the channel engages the tooth of the bead to prevent the bead from becoming accidentally dislodged from the channel. A second channel is formed in the upper surface of the coping for receiving the bead portion of a flexible pool cover. This second channel also includes a flange that engages the tooth formed on the bead portion of the cover to prevent inadvertent dislodging of the cover. When a cover is not used on the pool, a removable cover strip may lockingly engage the channel and lie flush with the top of the coping, thereby presenting a visually pleasing coping. The top of the coping appears unitary as the channel is hid by the cover strip. In addition, third and fourth channels are preferably formed in the inwardly and outwardly facing walls of the coping to receive aesthetic strips. The aesthetic strips may be, for example, extruded strips of colored plastic or fiber optic lighting that provide an illuminating strip. The aesthetic strips snap into the channels.

Figure 7:
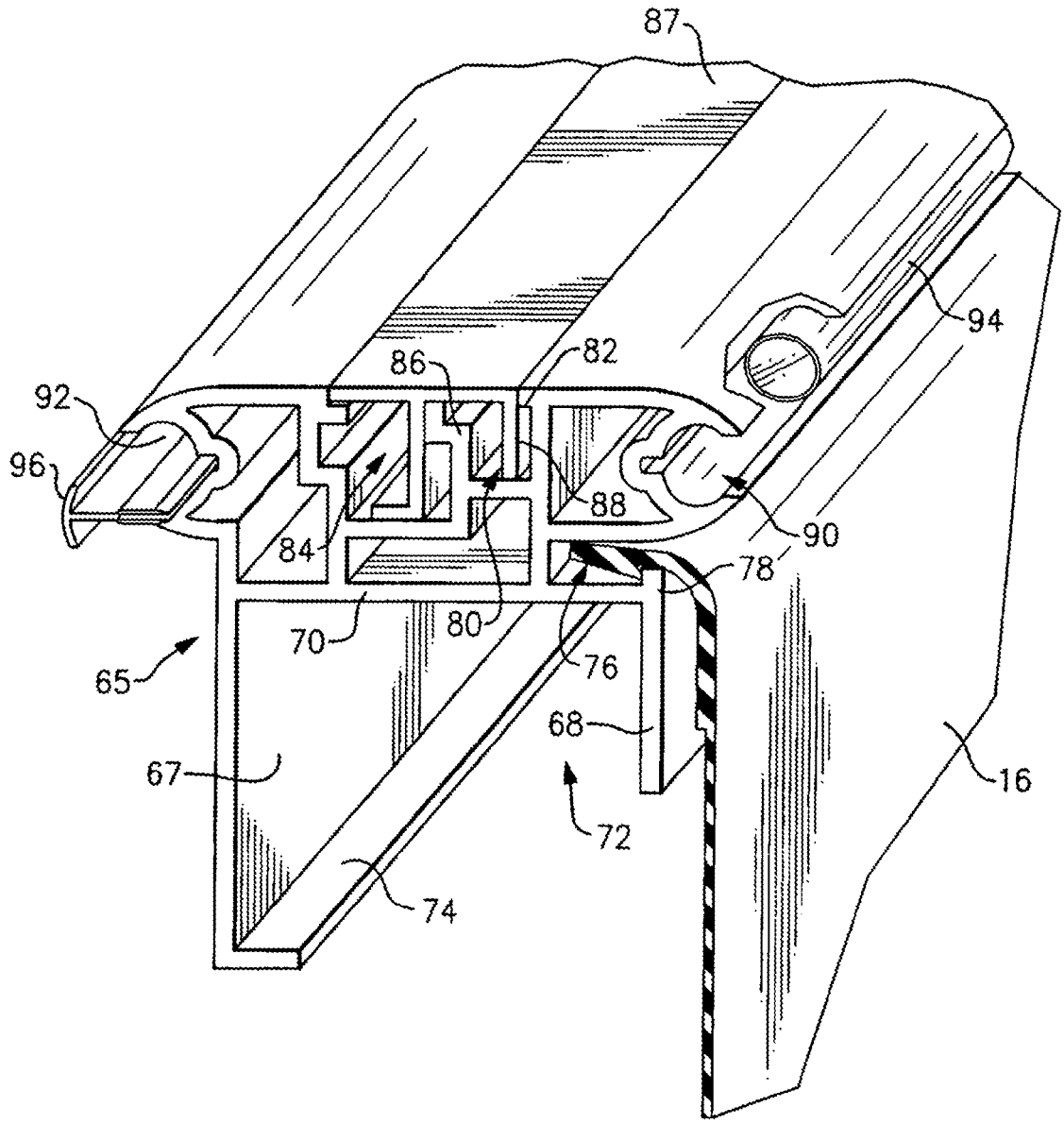
FIG. 7 shows a partial perspective view of a pool liner interconnected with a coping in an embodiment of the present invention.
Figure 8:
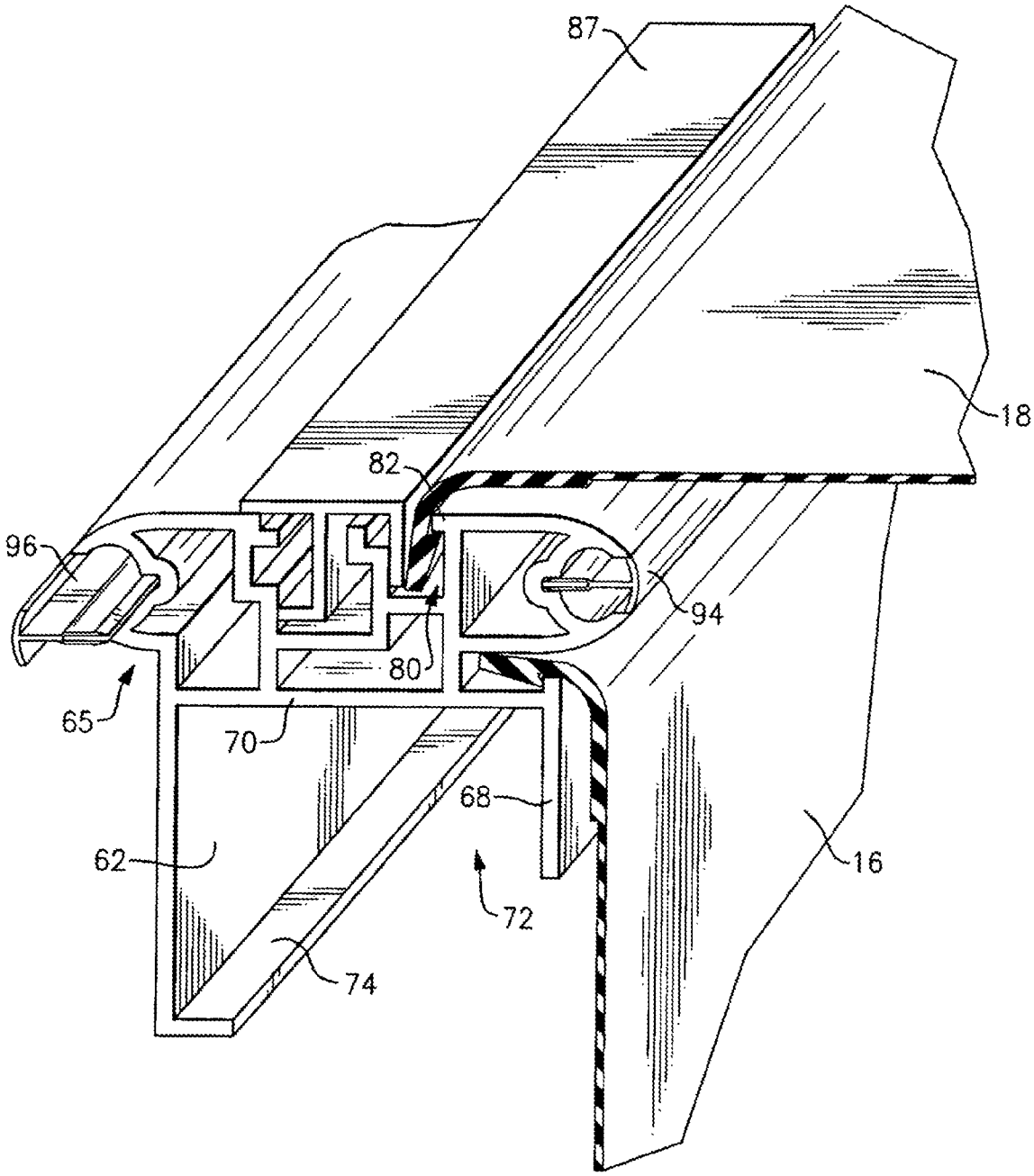
FIG. 8 shows a partial perspective view of a coping, a pool liner, and a pool cover interconnected in an embodiment of the present invention.

Referring to FIGS. 1-10, a portion 10 of a site-assembled pool includes a plurality of staves 12 that form a support wall for the pool. As used herein, a "pool" may be any water-containing vessel, including, but not limited to a swimming pool or whirlpool. The staves 12 are conjoined side-by-side to form the panels 14, and the panels are interconnected to one another to form the support wall of the pool. Although the panels are shown with the staves linearly aligned with straight top and bottom rails, the panels may have a slight curvature in combination with curved top and bottom rails and copings within the spirit of the present invention. As shown in FIG. 8, a conventional flexible liner 16 may be interconnected to the panels 14 to contain water in the pool, and a conventional flexible cover 18 may be interconnected to the panels 14 to provide a solar or weather cover for the pool.

Figure 3A:
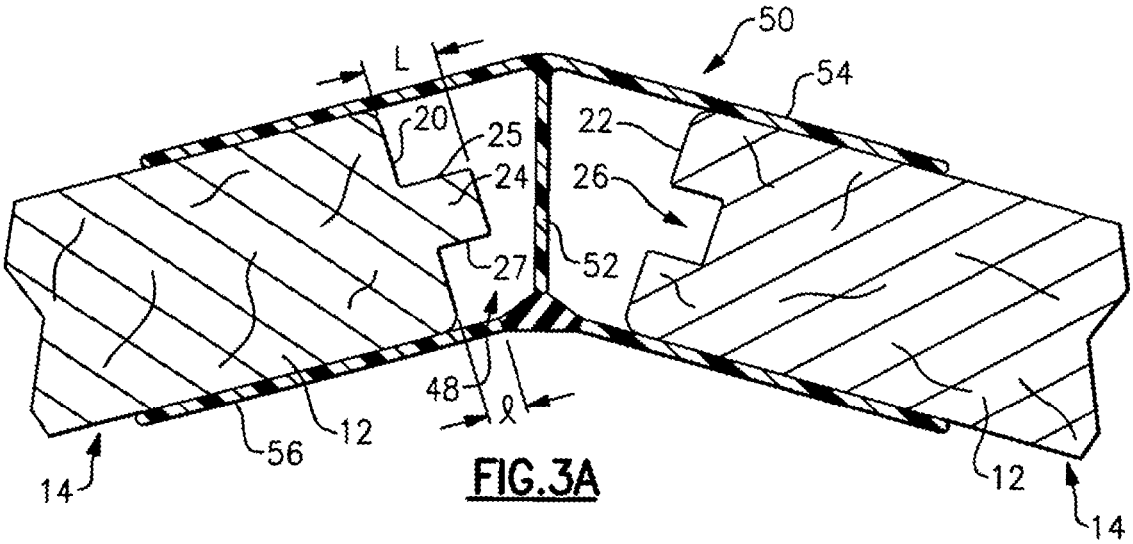
FIG. 3A shows a cross-sectional plan view of the staves and joint cover of FIG. 1 along section line 3A-3A.

FIG. 3A shows staves 12 having opposing vertical edges 20, 22 with a modified tongue 24 and groove 26, respectively. In an assembled panel 14, the staves 12 are arranged side-by-side with the tongue 24 of one stave engaging or nesting within the groove 26 of the adjacent stave. Once the predetermined number of staves 12 are arranged side-by-side to form the panel 14, an L-shaped top rail 28 is mounted over the top ends of the staves and an L-shaped bottom rail 30 is mounted to the bottom ends of staves 12. Fasteners 32, 34, such as the illustrated screws, pass through the rails 28, 30, respectively, and into the staves 12, thereby securely connecting the staves to the rails.

As illustrated in FIG. 3A, the tongue 24 is modified in that its outwardly facing edge 25 is longer (length L) than its inwardly facing edge 27 (length l). With reference to FIG. 3E, the offset provides a gap between the outer edges of adjacent staves 14. Due to the potential crooking that occurs with wooden staves, if the tongue 24 were conventional, there would be portions of the outer edges of adjacent staves 14 that would contact the groove 26 and other non-contacting portions, thereby creating an aesthetically displeasing gap between adjacent seams. By providing a gap that cannot be closed due to the offset, the visual perception of adjacent boards is that the gap exists, even if the gap is slightly larger in certain regions of the staves than in others.

The top rails 28 and bottom rails 30 each include projecting portions 36, 38, respectively, that extend outwardly beyond the end staves 12 in each panel 14. The projecting portions 36, 38 each preferably include a respective opening, and each extends in a plane slightly offset from the plane in which the edges of the rails extend. To interconnect a pair of panels 14 together, the openings of the projecting portions 36 and 38 of one panel 14 are axially aligned with the openings of the projecting portions 36 and 38 of those extending from the adjacent panel 14. A bolt 44 or similar fastener is then passed through the aligned openings and secured with a nut 46. Securing adjacent panels 14 together in this manner creates a gap 48 between the panels 14 that is approximately twice the width of one of the projecting portions 36, 38.

Figure 5:
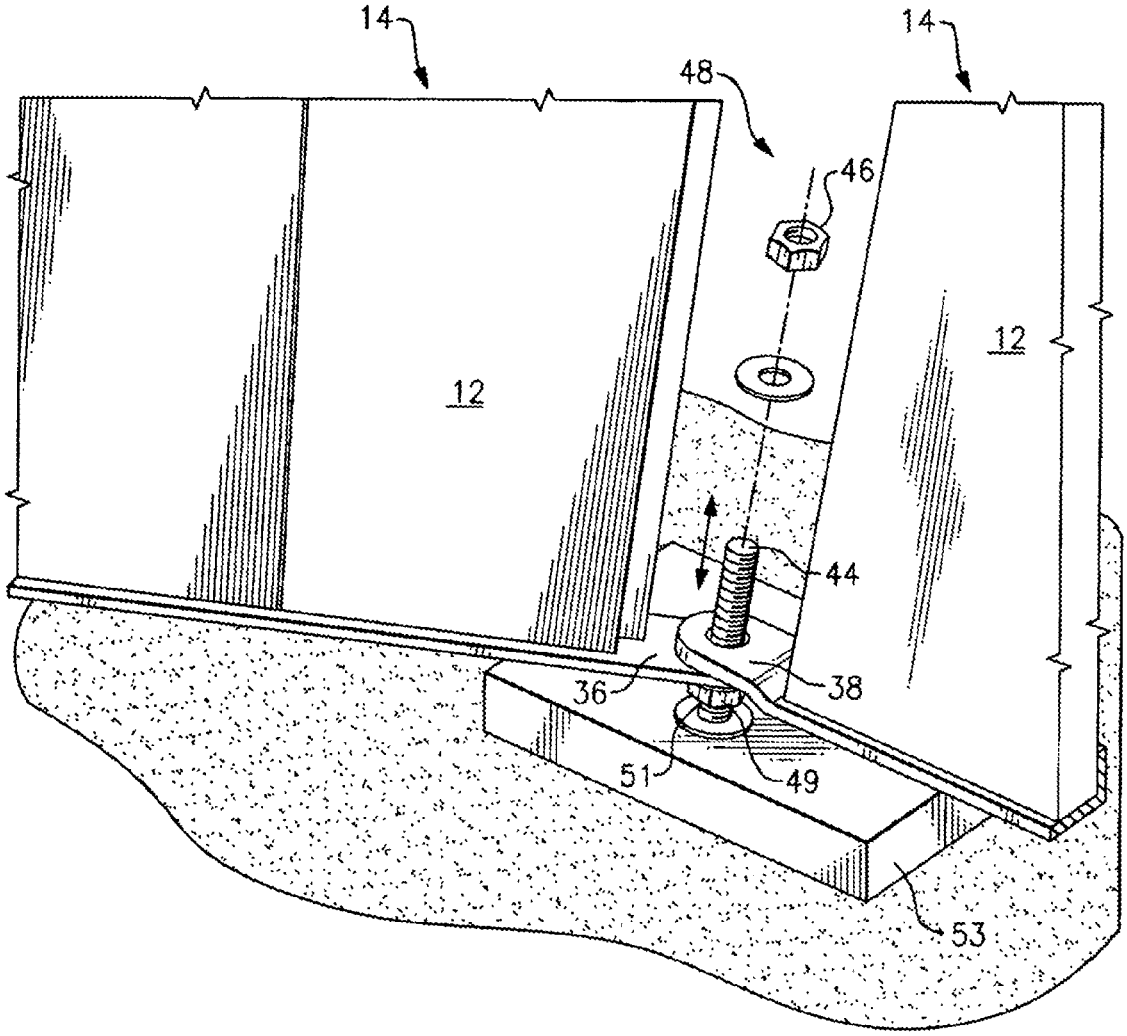
FIG. 5 shows a partial perspective view of the lower edges of adjacent panels of staves in an embodiment of the present invention.
Figure 6:
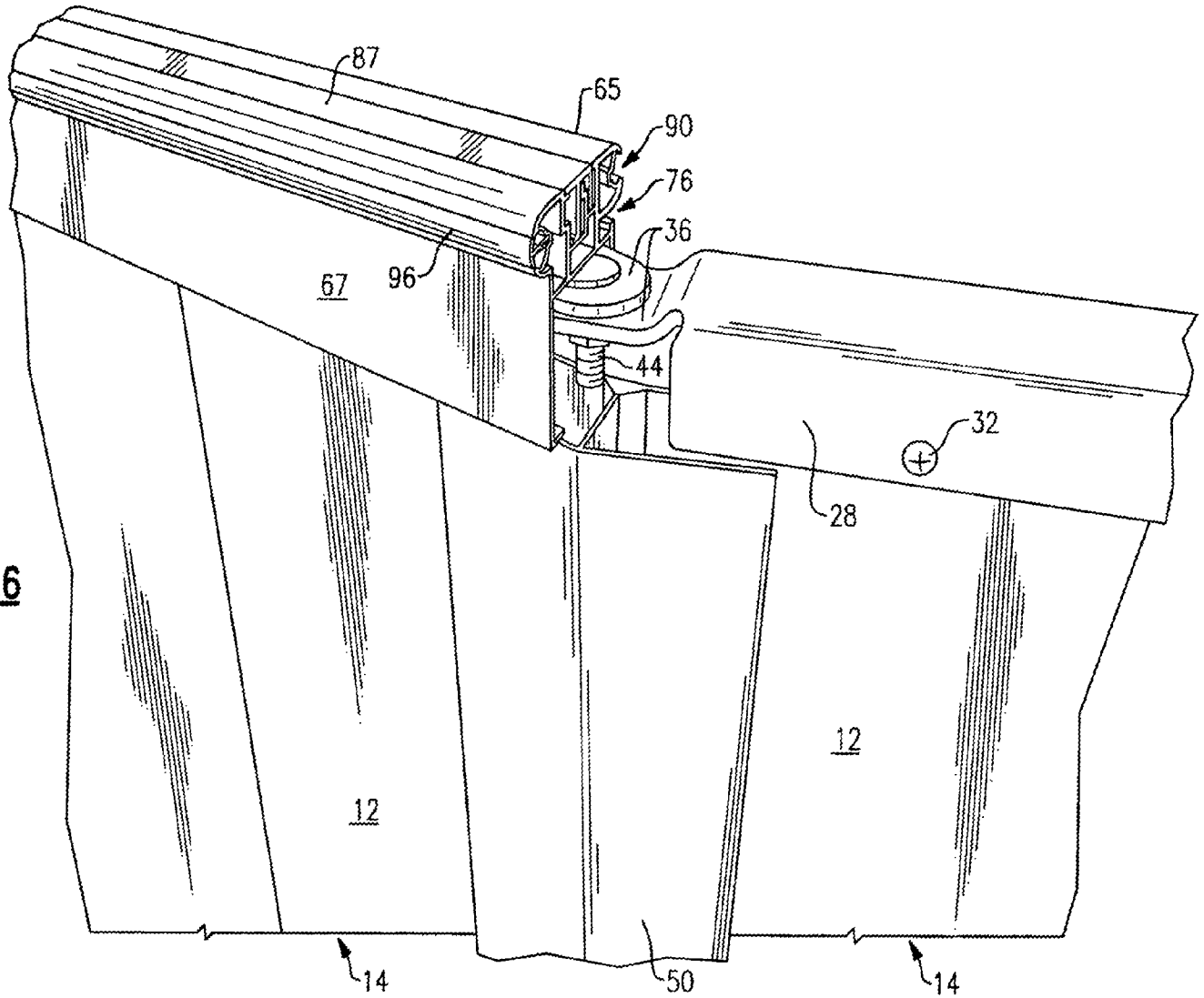
FIG. 6 shows a partial perspective view of the upper edges of adjacent panels with a coping positioned on one panel and a joint cover disposed between the panels in an embodiment of the present invention.

The bolt 44 that passes through openings in the bottom projections 38 is preferably vertically adjustable as illustrated by the two-headed arrow in FIG. 5 via a nut 49 that may be threadably advanced along the length of the bolt 44 beneath the projections 38. In addition, the head 51 of the bottom bolt 44 is flat so that it may lie flat on a concrete block 53. When each successive panel 14 is connected to an adjacent panel, the bottom bolts 44 interconnecting the panels are preferably vertically adjusted to ensure that the panel is level. By leveling each panel 14 during the construction phase, the pool 10 is level when complete, and the blocks 53 need not be level relative to one another.

To eliminate the gap 48 that exists between adjacent panels 14, thereby preventing the liner 16 from slipping through, a joint cover is preferably used. In one embodiment, the joint cover 50 includes a medial portion 52 that extends between adjacent panels 14, an outer face 54 that conforms to and contacts the outer surface of the end staves 12 of adjacent panels 14, and an inner face 56 that conforms to and contacts the inner surface of the end staves 12 of adjacent panels 14. The joint cover 50 may be composed of any semi-rigid or rigid material that provides enough rigidity to effectively seal the gap 48. In one embodiment, the joint cover 50 is composed of a semi-rigid plastic, and more specifically, polyvinyl chloride (PVC). In another embodiment the joint cover is composed of a metal or metallic material.

Figure 3B:
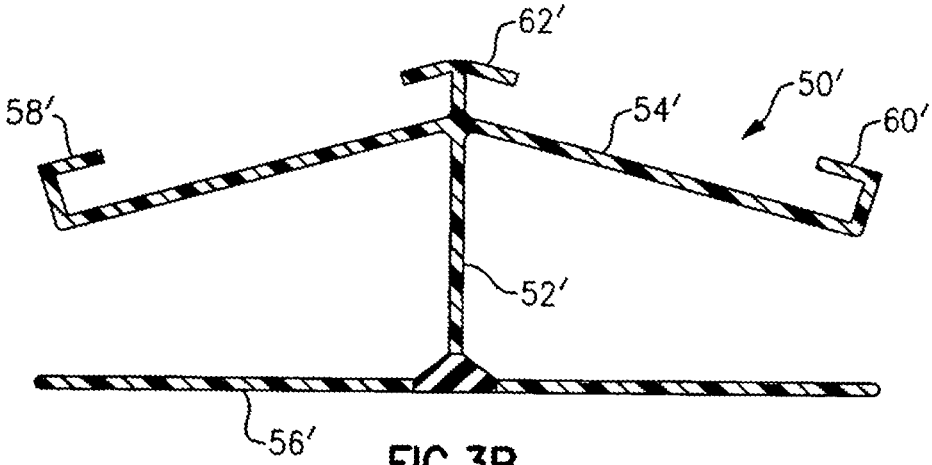
FIG. 3B shows a cross-sectional plan view of a joint cover of a pool in another embodiment of the present invention.
Figure 3E:
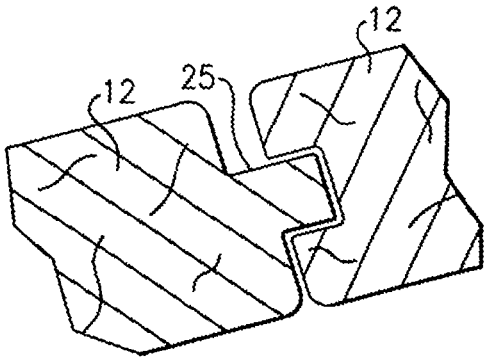
FIG. 3E shows a cross-sectional plan view of a portion of adjacent staves in an embodiment of the present invention.
Figure 3C:
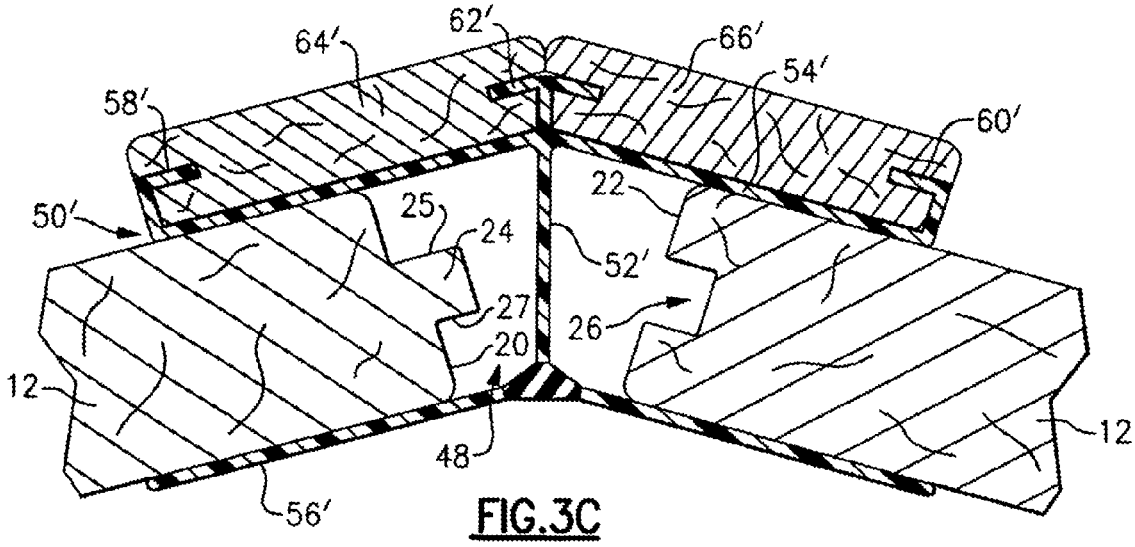
FIG. 3C shows the joint cover of FIG. 3B with adjacent staves and wooden boards.

An alternate embodiment of a joint cover 50' is shown in FIG. 3B and FIG. 3C. The joint cover 50' includes all the features of the joint cover 50 of FIG. 3A, but further includes a series of flanges 58', 60', and 62' extending from the opposing ends of the outer face 54' and medial portion 52', respectively. The flanges 58', 60', and 62' engage wooden boards 64', 66' that extend the length of staves 12 and cover the outwardly facing portions of the joint cover 50', thus creating as aesthetically pleasing exterior view of the pool 10.

Figure 3D:
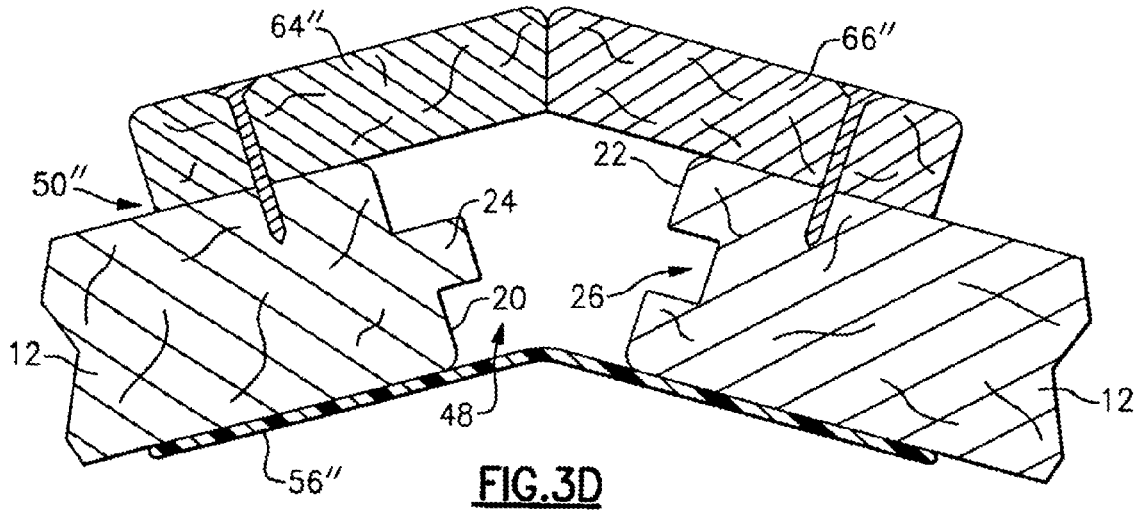
FIG. 3D shows a cross-sectional plan view of a joint cover, adjacent staves, and wooden boards in another embodiment of the present invention.
Figure 4:
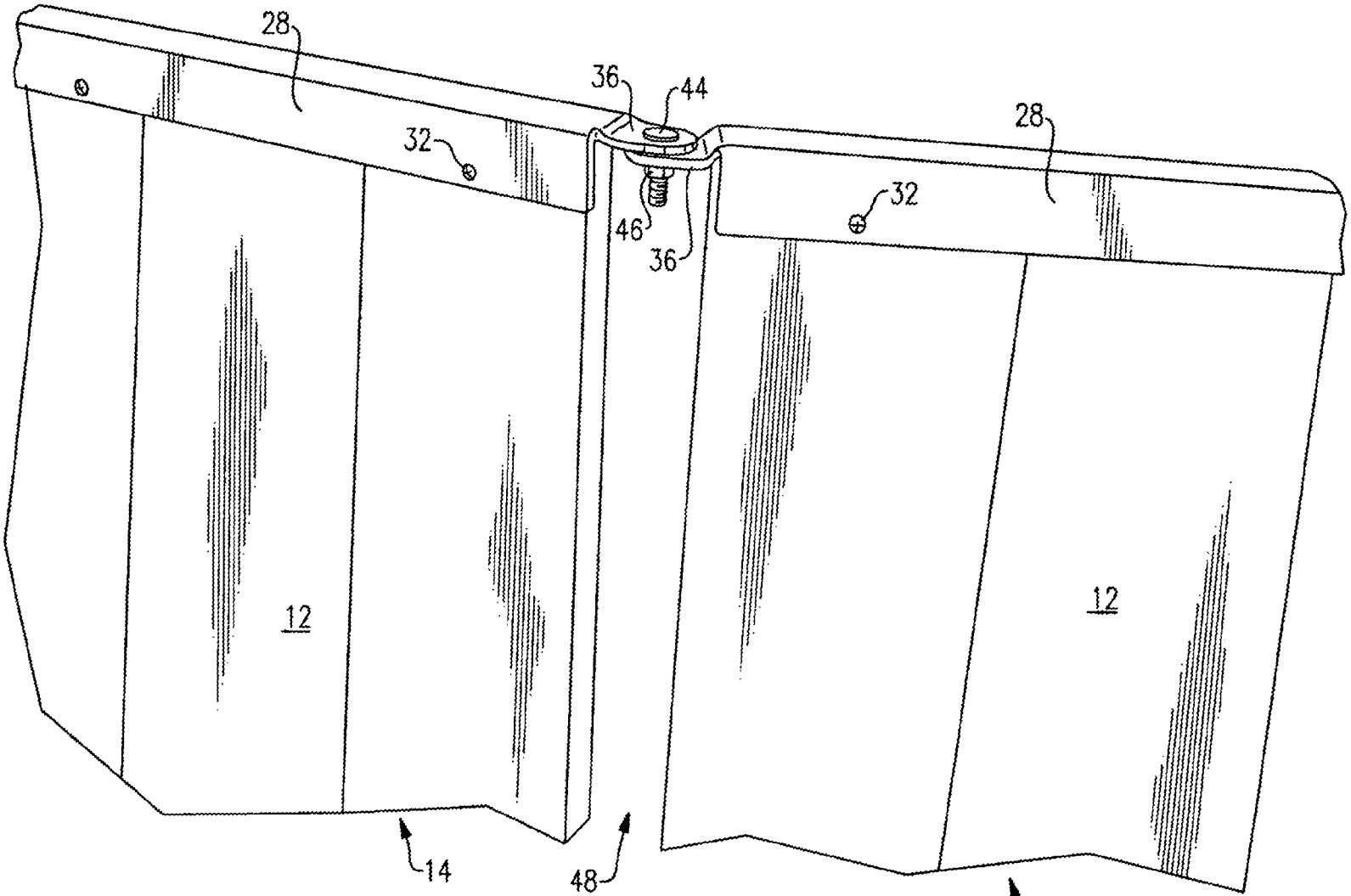
FIG. 4 shows a partial perspective view of the upper edges of adjacent panels of staves in an embodiment of the present invention.

A further embodiment of a joint cover 50" is illustrated in FIG. 3D. The joint cover 50" is secured to and covers the gap between the inwardly facing surfaces of adjacent staves 12. Unlike the joint covers 50 and 50' of FIG. 3A and FIG. 3B, respectively, the joint cover 50" of FIG. 3D does not extend into the gap that exists between the adjacent staves. Instead, a pair of wooden boards 64", 66" are securely attached to the outwardly facing surfaces of the adjacent staves 12, with each board covering approximately half of the gap that exists between the staves. Screws, or equivalent fastening elements, may be used to interconnect the boards 64", 66" to the staves 12. As with the boards 64', 66' in FIG. 3C, the boards 64", 66" in FIG. 3D create an aesthetically pleasing exterior view of the pool.

Once the panels 14 are assembled with the rails 28, 30, a coping 65 preferably is attached to the upper ends of the rails 28 of the panels 14. The coping 65 includes a pair of legs 67, 68 held in a spaced parallel relationship to one another by a cross member 70 and defining a downwardly facing groove 72. The outer leg 67 includes a narrow flange 74 extending inwardly. The coping 65 is attached to a top rail 28 by placing it over the rail with the flange 74 snappingly engaging the bottom edge of the rail 28. The coping 65 is preferably composed of PVC or a similar material that permits some flexure of the material while providing the necessary structural rigidity to achieve its purpose.

The coping 65 shown in FIG. 7 further includes a first channel 76 formed in its inwardly facing side surface and partially defined by the cross member 70 (defining the bottom of the channel) and the inner leg 68 (defining the leading edge of the channel). The first channel 76 includes a narrow, upwardly-extending flange 78 formed by the inner leg 68 at its leading edge. The channel 76 is adapted to receive the bead portion of the liner 16 with the flange 78 preventing inadvertent dislodgement of the bead portion.

The coping 65 further includes a second channel 80 formed in its upper surface that includes a horizontally-extending, narrow flange 82 formed along its forward edge. The channel 80 is adapted to receive the bead portion of the cover 18 with the flange 82 preventing inadvertent dislodgement of the bead.

A third channel 84 is preferably formed in the upper surface of the coping 65 adjacent to the second channel 80, with a wall 86 dividing the second channel 80 from the third channel 84. The third channel 84 removably receives a strip 87. The strip 87 includes a downwardly extending leg 88 that engages the second channel 80 and pinches and retains the cover 18 in secure position within the second channel 80, or simply encloses the channel if no cover is in place.

Preferably, fourth and fifth channels 90, 92, respectively, are longitudinally formed along the opposing side edges of the coping 65. These channels 90, 92 preferably receive ornamental strips 94, 96, respectively, therein. The strips 94, 96 may be colored plastic, fiber optic lighting strips, or other ornamentally decorated strips.

Figure 9:
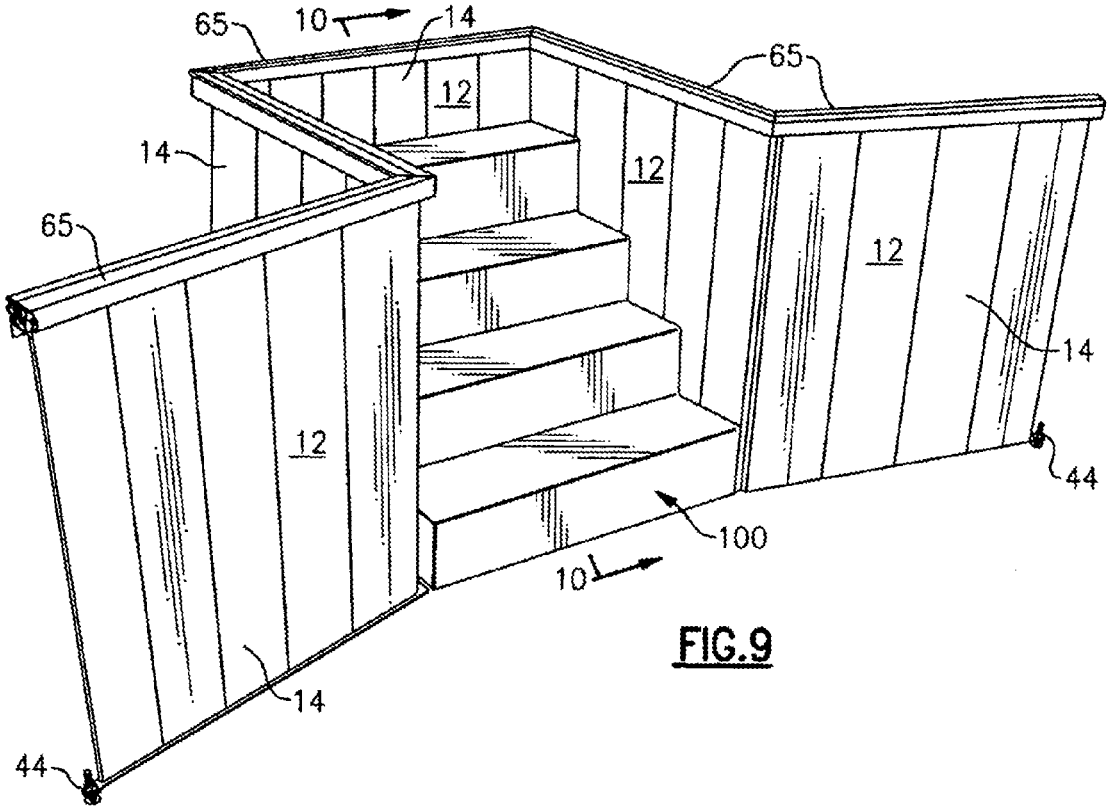
FIG. 9 shows a perspective view of stairs in an embodiment of the present invention.
Figure 10:
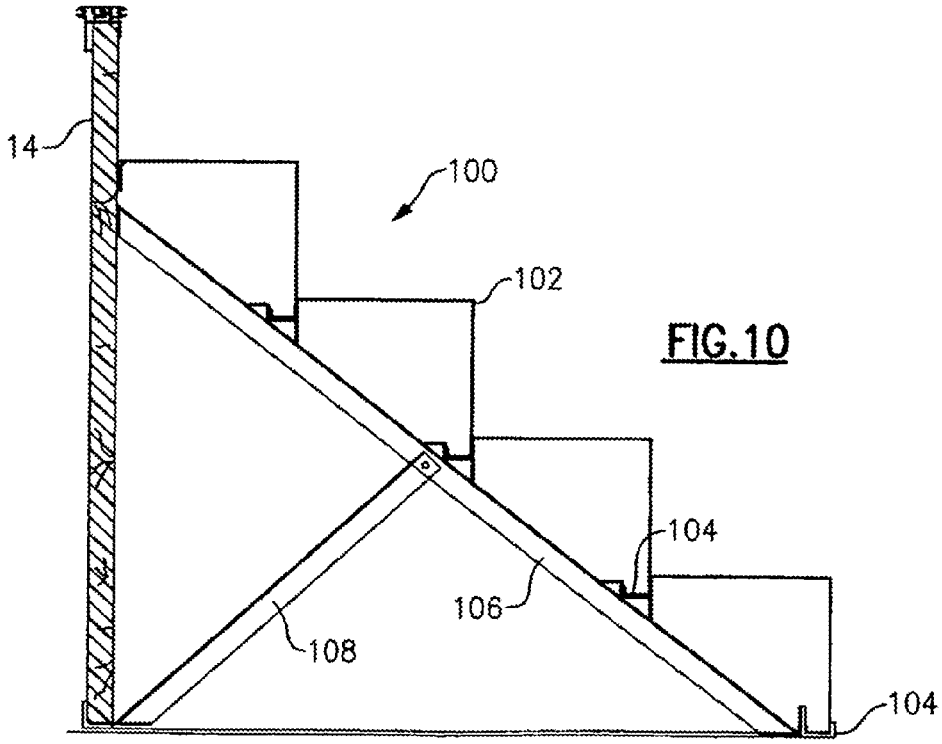
FIG. 10 shows a cross-sectional view of the stairs of FIG. 9 along section line 10-10.

Referring now to FIG. 9 and FIG. 10, a set of stairs 100 may be incorporated into the pool 10. The stairs 100 include a series of three support walls 14 that define a space, typically rectangular, in which the steps 102 are positioned. It is within the scope of the present invention that more than three support walls may be needed depending on the shape and size of the stairs, and three walls are only used as exemplary of the invention. The steps 102 include reinforcing brackets 104 that fix them to a support stringer 106 that extends diagonally from the bottom-most step to the rear support wall. An additional brace 108 extends diagonally from the base of the rear support wall 14 to the approximate middle of the support stringer 106. The support stringer 106 and brace 108 are necessary to support the weight and pressure created by the water filling the pool 10.

A site-assembled pool as described in FIGS. 1-10 is preferably constructed and assembled by the methods described below. In one embodiment, a leveling gauge of the present invention is used to aid in leveling a relatively circular area of ground, in positioning the blocks and panels on the ground, and in leveling a layer of sand on the ground within the enclosure during assembly of the pool. Although the leveling tool is described below for use in constructing and assembling a pool, the tool may be used in any application in which a curved or circular area of land is to be leveled, including, but not limited to, a silo or any other building having a circular footprint or a curved or circular area to be paved.

Figure 11:
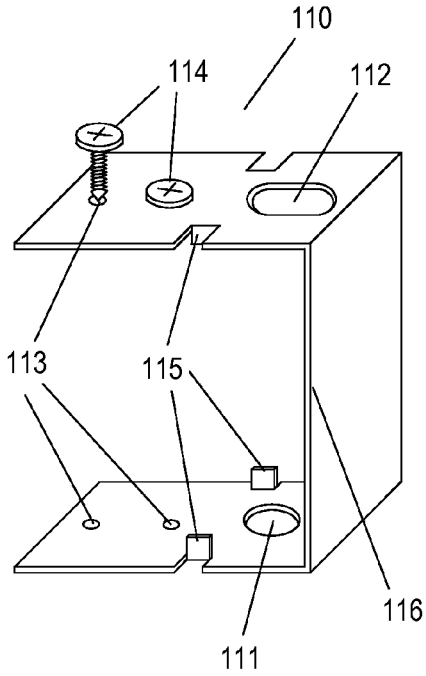
FIG. 11 shows a pivot bracket of a leveling gauge in an embodiment of the present invention.
Figure 12:
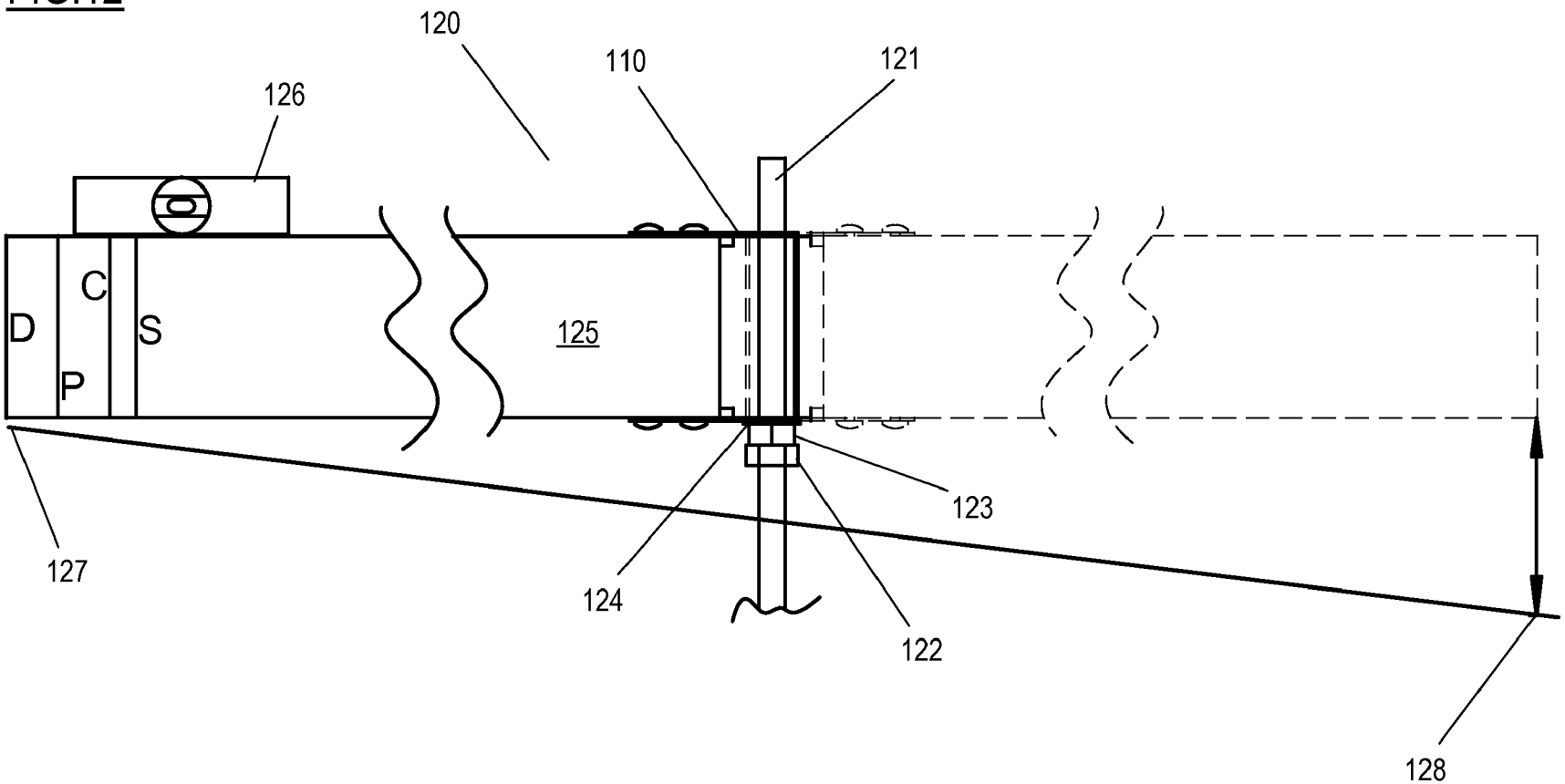
FIG. 12 shows a leveling gauge in an embodiment of the present invention.

A relatively level area of land is preferably selected for the pool site. In a preferred method, a multipurpose leveling gauge of the present invention is used to level the ground prior to pool construction. A preferred leveling gauge 120 is shown in FIG. 12. The leveling gauge includes a threaded rod 121 driven into the ground at the desired location of the center point of the pool and a pivot bracket 110 mounted on the threaded rod 121. The use of this leveling gauge in the construction of a pool is described in more detail below. A preferred pivot bracket 110 for the leveling gauge is shown in FIG. 11. Other pivoting brackets may be used in a leveling gauge within the spirit of the present invention. At least one horizontal board 125, preferably a 2×4" piece of wood, is attached to the pivot bracket 110.

From the center point, a dig radius is marked as a circle on the ground. The dig radius is predetermined based upon the predetermined size of the pool to be built, as shown for a number of different pool sizes in column D of Table 1. The dimensions in Table 1 are based on panels having a distance of 42⅝" between holes of the projecting portions of the rails. Although the panels in the examples below were sized to provide options for pools having diameters of 12, 15, 18, 21, 24, and 27 feet, which are considered standard sizes for above-ground pools, any panel size may be used to construct a pool within the spirit of the present invention. In Table 1, column B represents the side-to-side gauge 130 length between blocks 12 (see FIG. 13 and discussion below), column C represents the distance from the edge 116 of the pivot bracket to the center point of the inside edge of a block, column D represents the dig radius measured from the edge 116 of the pivot bracket, column P represents the distance from the edge 116 of the pivot bracket to the inside edge of the panel positioning guide 140 (see FIG. 14 and discussion below), and column S represents the distance from the edge 116 of the pivot bracket for the sand leveling gauge 170 (see FIG. 17 and discussion below).

The dig radius circle may be marked with any marker, such as chalk, flour, or spray paint. The dig radius is preferably about 6" larger than the outside measurement of the blocks upon which the ends of the rails of the panels are mounted. A greater dig radius may be used to allow for installation of proper drainage or a retaining wall if necessary or desired. The lowest point in the dig area is determined, and the entire dig area is then leveled preferably to within one inch of the lowest point.

TABLE 1

Dimensions for Pool Sizes

| Pool Diameter | B | C | D | P | S |
|---|---|---|---|---|---|
| 12' 4" (11 panels) | 25½" | 72⅜" | 90" | 75 13/32" | 72 3/16" |
| 15' 10" (14 panels) | 25 11/16" | 92 9/32" | 114" | 95 17/32" | 93" |
| 18' (16 panels) | 25 13/16" | 105¾" | 126" | 109" | 106¾" |
| 21' 4" (19 panels) | 25 31/32" | 126" | 144" | 129¼" | 127¼" |
| 24' 10" (22 panels) | 26 1/16" | 146¼" | 174" | 149½" | 147¾" |
| 27' 1" (24 panels) | 26⅛" | 159 25/32" | 180" | 163 1/32" | 161½" |

If the bottom of the pool is to be tapered, it is best to first excavate the entire perimeter until it is level. After the perimeter is leveled, an inner edge of the blocks is marked, such as with chalk, flour, or spray paint, and 6-12" of level ground is left inside this inner dimension. The dirt is then excavated in the innermost area to form a gradual taper towards the center point to a maximum depth of 4-8" depending on the size of the pool. The smaller the pool, the less the bottom should be lowered. If the taper is too great, the liner may become overstretched in the pool and wrinkles may form that can not be removed.

When a leveling gauge 120 of the present invention is used to determine the excavation required to level the dig area, the pivot bracket 125 is mounted to a board 125 or series of boards, preferably 2×4" in cross section, about 1½" less than the dig radius in length. If one board is not long enough, multiple boards may be attached together to achieve the desired length. The pivot bracket 110 is slid over one end of the horizontal board 125, until the end of the board contacts four tabs 115 extending toward the inner part of the bracket 110, and attached to the horizontal board by fasteners 114 through holes 113 in the pivot bracket. Preferably, the pivot bracket has four pre-punched holes, with four #10×¾" stainless steel screws through the holes being used to hold the horizontal board in the pivot bracket. A tape measure hooked to the end 116 of the bracket is used to measure the dig radius (D), inner dimension (C), the edge of the panel positioning guide (P), and the edge for sand leveling (S), which are then preferably marked on the horizontal board 125 as shown in FIG. 12. The horizontal board may be cut such that the distal end of the board is at the dig radius (D) or the board may be longer than the dig radius (D), with a line being marked on the board to indicate the dig radius. The board 125 need not be straight, but the marked distances on the board need to be measured in a straight line from the end 116 of the bracket.

Two nuts 122, 123 are threaded onto the threaded rod 121 so that the top nut 123 is just above the end thread. The nuts are then tightened against each other to protect the threads from damage when pounding the threaded rod 121 into the ground. The threaded rod 121 is held plumb and pounded into the ground until it is held in the ground with no side to side movement at the base. The nuts are then loosened and threaded down the threaded rod at least 4". The washer is slid down the threaded rod so that it rests on the nuts. A level 126 is taped or otherwise affixed preferably on the top edge of the horizontal board 125 near the far end away from the pivot bracket as shown in FIG. 12. The pivot bracket 110 is slid down the threaded rod 121, with the oval hole 112 on top and the round hole 111 facing down, until the round hole 111 rests on the washer 124. The oval hole and the round hole are in alignment with respect to the long axis of the oval hole. The oval hole is oriented with its long axis in the direction that the horizontal board extends from the bracket.

As shown schematically in FIG. 12, to locate the high point 127 in the dig area, the assembled leveling gauge is rotated around the threaded rod while maintaining a level reading on the level. The nuts on the threaded rod are lowered until the bottom of the horizontal board contacts the ground at one point. This contact point is the high point 127. The ground at the high point is preferably marked for reference. The nuts are then tightened against each other with the horizontal board touching the high point. The leveling gauge is then rotated at this height while maintaining a level reading and the area with the greatest distance between the horizontal board and the ground is determined. This area is the low point 128. The sod is then removed at the low point and the distance between the bottom of the horizontal board and the ground, while maintaining a level reading, is determined. The nuts on the threaded rod are then loosened and lowered the distance of the measurement and tightened against each other. It may be necessary to dig down around the threaded rod to be able to lower the nuts to this level. The dirt from within the perimeter is then removed until the variation in elevation within all of the area is within about an inch. This may be determined by rotating the leveling gauge with a level reading and the pivot bracket resting on the washer and observing the distance between the bottom surface of the horizontal board and the ground.

After the excavation is completed, the leveling gauge is rotated around to find the high point of the excavated area. The first block 53 is placed at the high point so that the center of the inside edge of the block is even with the C-mark on the horizontal board. The leveling gauge is then rotated to the right (clockwise) of this first block, and the first block is adjusted to be level in the left-to-right direction and then the front-to-back direction. The leveling gauge is rotated back to the middle inside edge of the block to confirm alignment of the C-mark or re-adjust the block if necessary.

Figure 13:
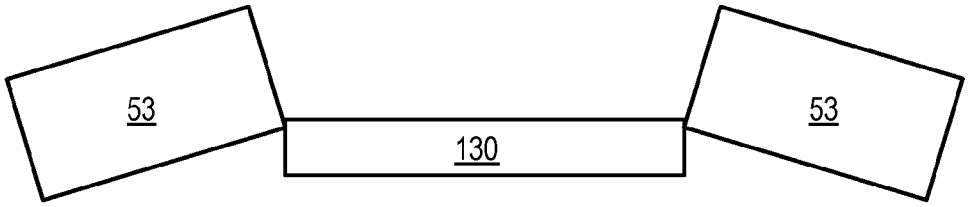
FIG. 13 shows a side-to-side gauge in an embodiment of the present invention.

A spacer board, preferably a 2×4" piece of wood, cut to have a length equal to the B-distance is used as a side-to-side gauge 130 to locate the next block a nearest-corner distance B from the first block in combination with the leveling gauge to locate the inside center side of the block a distance C from the center point of the pool. More specifically, he side-to-side gauge is preferably placed to the right of the first block so that it contacts the inside right corner of the block. The second block is placed so that the left inside corner of the second block touches the side-to-side gauge, as shown in FIG. 13, and the center inside edge of the second block is aligned with the C-mark on the horizontal board. The B-distance assumes blocks having a length of 15⅝", but variations in block sizes may require adjustment of the B-distance. Each block is preferably leveled as described previously prior to placing the next block. Third and fourth blocks are preferably placed and leveled prior to mounting the first panel 14. The center of the second block with respect to the left and right edges is determined and a line across the center of the block extending in the direction of the center point of the pool is drawn across the block.

Figure 14:
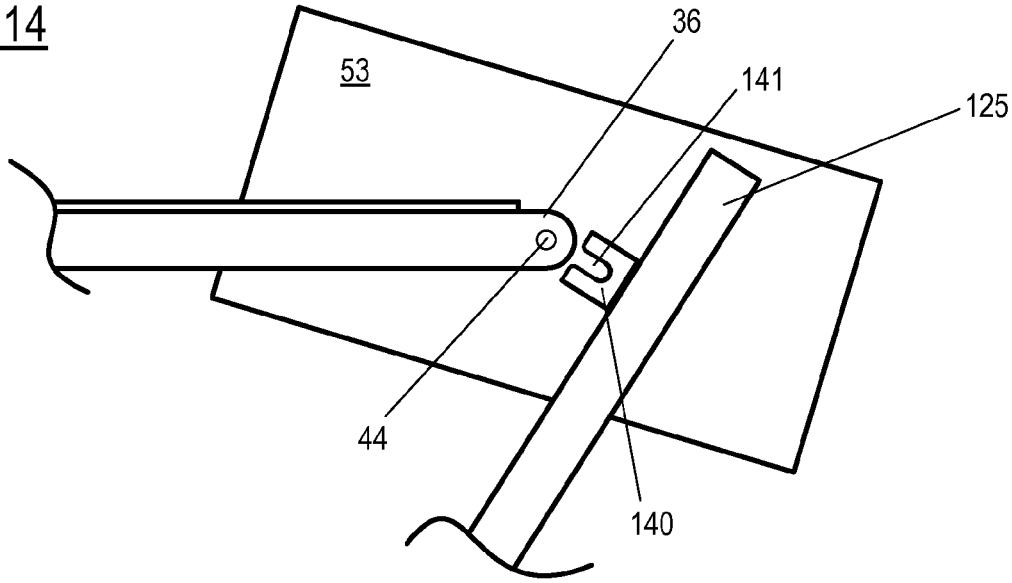
FIG. 14 shows a top view of a panel positioning guide in an embodiment of the present invention.
Figure 15:
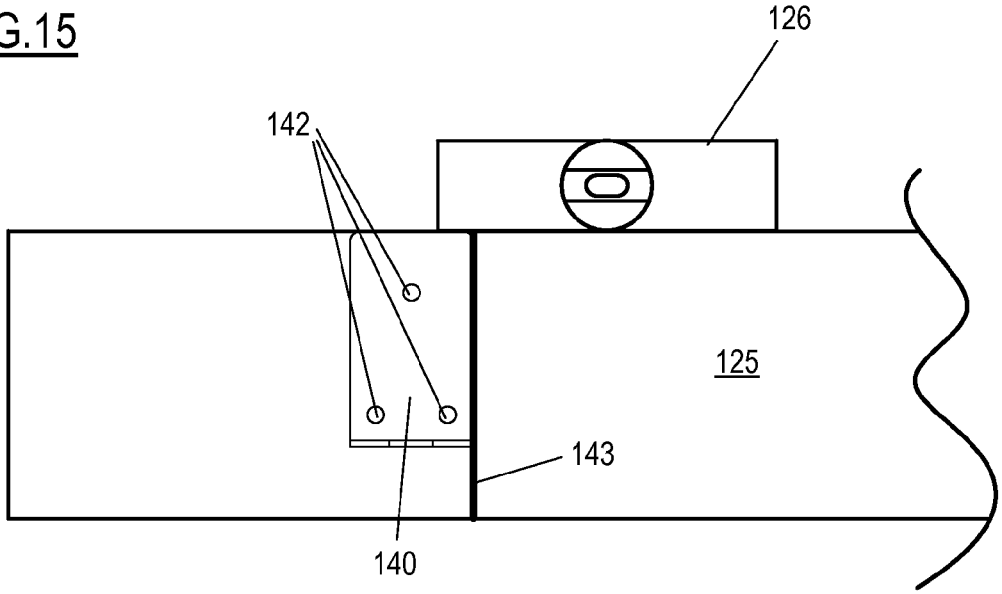
FIG. 15 shows a front view of the guide of FIG. 14.

A panel positioning guide 140 is then attached to the horizontal board 125 by at least one fastener through holes 142 in the guide 140 so that the top edge is even with the top of the horizontal board 125 and the right edge is on the P-line 143 as shown in FIG. 14 and FIG. 15. The panel positioning guide 130 has a u-shaped recess 141 that fits around the leveling bolt 44 when the panel is properly placed. The panel positioning guide 140 is preferably attached to the horizontal board using three #10×¾" stainless steel screws.

Prior to the assembly of the pool structure, a nut 49 is preferably threaded all the way down the threads of each leveling bolt 44 with a washer on top of the nut. The first leveling bolt is then inserted through the hole in the projecting portion 36 on the right side of the first assembled panel 14. The bolt is preferably clamped in place with a clip on the bolt above the projecting portion. The assembled panel 14 is set on the first and second blocks so the bolt 44 is centered on the center line marked on the second block. A 1-inch spacer is placed on the first block under the left projecting portion 38 of the panel.

After the first panel is initially placed on the first and second blocks, the clip is removed from the leveling bolt. The center of the leveling bolt is then aligned with respect to its distance from the center of the pool using the panel positioning guide on the leveling gauge while maintaining alignment of the bolt with the center line of the second block. It is important that the threaded rod is positioned in the ground securely so that it does not move during placement of the panels to avoid setting the panels at an improper circumference for the desired finished pool size. When the u-shaped projection of the panel positioning guide is flanking the leveling bolt in the projecting portion 36 with the bolt centered on the center line of the block, the leveling bolt is properly located. The panel is leveled by adjusting the nut 49 on the bolt 44, and the leveling gauge is rotated away from the bolt.

The second panel is placed in the same manner to the right of the first panel, with the following exceptions. The left projection portion 38 is placed over the bolt 44 so that it rests on top of the right projecting portion 36 of the first panel. A washer is placed over the bolt 44 followed by a nut 46 to hold the projecting portions on the bolt. A bolt 44 through the right projecting portion of the top rail 28 of the first panel and the left projecting portion of the top rail of the second panel is held in place with a nut. Since the first leveling bolt 44 has been properly placed, it is not necessary to have a center line on the third block for alignment of the right projecting portion of the second panel. The panel positioning guide alone properly locates the bolt. The remaining blocks may be added as needed or all at once prior to continuing assembly. Except for the last panel, the remaining panels are added and leveled in the same manner as the second panel. In a preferred embodiment, one of the panels 14 is pre-cut with holes in the staves 12 for a skimmer and a return fitting.

For placement of the last panel, the nut 46 of the bolt attaching the top rails of the first and second panels and the top nut 46 on the leveling bolt attaching the bottom rails of the first and second panels are loosened so that the first panel may be rotated outward off the first block. The 1-inch spacer is removed from under the left projecting portion of the first panel. The last panel is then set in place to the right of the second-to-last panel. The pivot bracket and horizontal board portion of the leveling gauge is then removed from the dig area and preferably saved for future use. The nut, washer, and bolt are then removed from the top rails of the first and second panels and the top nut on the leveling bolt between the first and second panels is loosened enough to allow the left projecting portion of the bottom rail of the first panel to be placed onto the last leveling bolt. After the first panel has been mounted onto the last leveling bolt, the connections between the first and second panels are re-established and the connections between the last and first panels are completed. Finally all connections should be checked and tightened as necessary.

Joint covers are placed by squeezing the flexible flaps toward each other to form a T-shape and inserting them through the space between the panels starting at the bottom of each panel. The joint covers rest on the vertical legs of the rails. The flexible flaps are then taped to the pool wall from the inside of the pool.

As shown in FIG. 15, a cover lock 87 and T-trim 94, 96 are then inserted into the coping 65 prior to application of the coping to the top rails 28 of the panels 14. If not pre-cut, the coping is cut, preferably using a miter saw, to the length and size appropriate for the number of panels for the pool as shown in Table 2.

TABLE 2

Coping Dimensions

| Pool Size | Coping I.D. | Coping O.D. | Long Leg Dimension | Angle |
|---|---|---|---|---|
| 11 panels | 41⅞" | 43½" | 43 9/32" | 16.4 |
| 14 panels | 42 1/16" | 43 5/16" | 43⅛" | 12.9 |
| 16 panels | 42⅛" | 43 7/32" | 43 1/16" | 11.3 |
| 19 panels | 42 3/16" | 43⅛" | 43" | 9.5 |
| 22 panels | 42¼" | 43 1/32" | 42 29/32" | 8.2 |
| 24 panels | 42 5/32" | 43" | 42⅞" | 7.5 |

Figure 16:
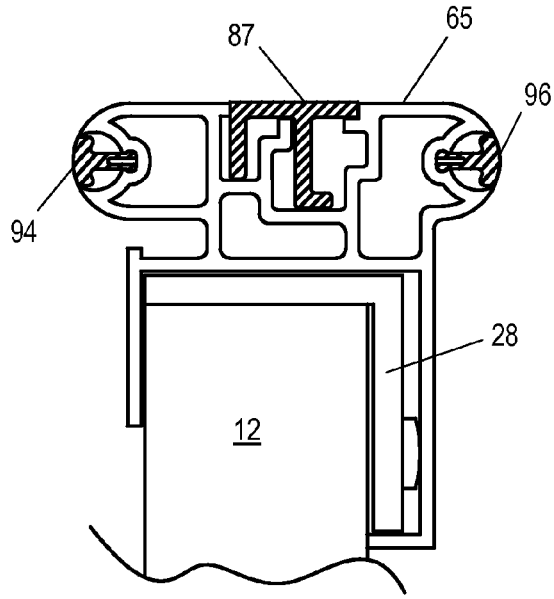
FIG. 16 shows a coping mounted to a top rail in an embodiment of the present invention.

A coping section is applied to each panel by placing the section over the top rail with the narrower section of the coping facing inward toward the pool, as shown in FIG. 16. A section of the coping snaps over the bottom of a section of the top rail to hold the coping in place and flush with the top rail. A slight gap of 1/32"-1/16" between coping sections is preferred to allow for thermal expansion of the coping.

Figure 17:
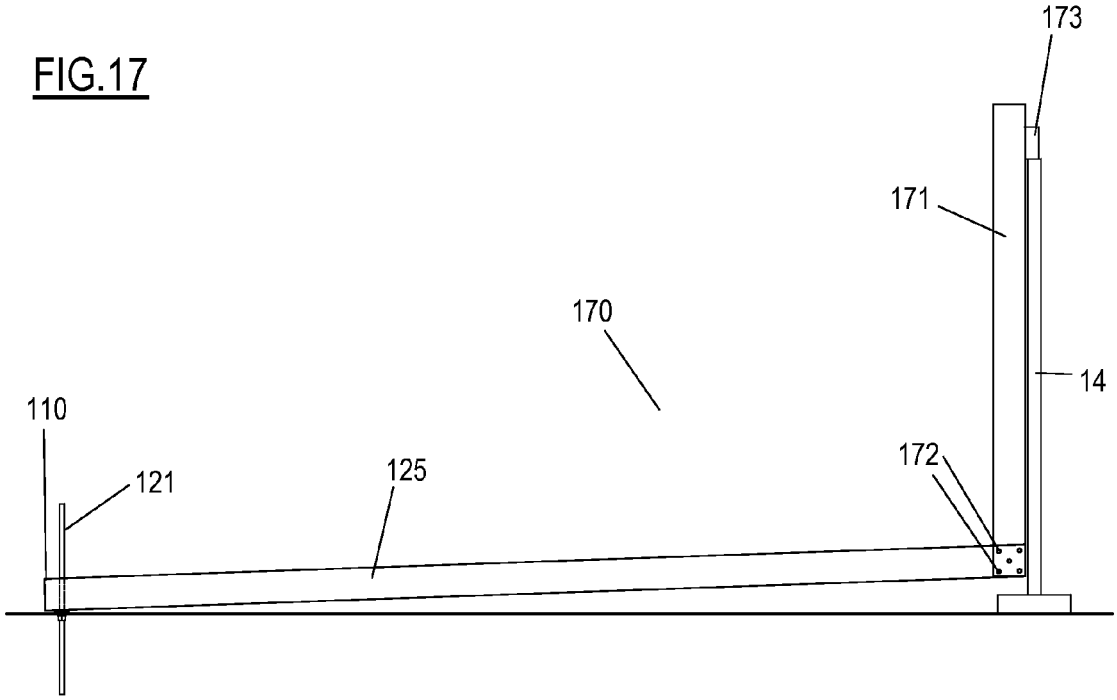
FIG. 17 shows a sand leveling gauge in an embodiment of the present invention.

The following steps are preferably taken to complete the construction of the pool. Trim, preferably made of wood or another decorative material, is installed over the outward-facing surfaces of the joint covers. A skimmer is mounted to the skimmer receiving hole of the skimmer panel. Knots, holes, or other large imperfections on the inside-facing surfaces of the staves are covered with tape or filled with wood filler, and wall foam is unrolled and taped to the inside-facing lower surface of the coping so that the wall foam covers the inside-facing surfaces of the pool walls except for where the skimmer, the return line, and any other additional features, including, but not limited to lights or additional lines, are to be located. It is recommended to attach the foam to the bottom of the pool wall as well to insure a better pool liner fit. The return line fittings and any light fittings are then installed. Preferably, a minimum of 2" of sand is then spread evenly around the pool bottom and raked smooth except for a small cove at the base of wall. The leveling gauge may be used as a sand leveling gauge 170 by cutting the horizontal board 170 at the S-line on the horizontal board. The pivot bracket is mounted onto the threaded rod at a height such that the bottom surface of the horizontal board near the threaded rod is at a desired height for the sand, as shown in FIG. 17. There should be approximately a ¼" gap between the end of the board and the pool wall at the center of a panel. A vertical board 171 is then attached by fasteners 172 to the end of the horizontal board 125 on the sand leveling gauge. A side piece 173 is attached to the vertical board such that when the side piece rests on top of the coping, the bottom surface of the horizontal board is at the desired angle for the top of the sand layer as the boards are rotated around the threaded rod. The orientation of the oval hole 112 of the pivot bracket with its long axis parallel to the length of the board allows the pivot bracket to be tipped up slightly to raise the board for an angled sand layer. The sand may be angled slightly to be shallowest at the center of the pool or may be level. The sand is repositioned with the sand leveling gauge or by hand until sand contacts the bottom of the horizontal board for the full rotation of the horizontal board while the side piece slides on the coping.

After the sand layer is positioned, the sand leveling gauge, including the threaded rod, is removed from the inside of the pool area. A pool liner is then positioned so the heavy tab or bead portion is easily inserted into the liner channel 76 of the coping 65. The bead portion is then mounted in the channel 76 of each coping around the pool circumference. Wrinkles are then removed from the liner by applying a vacuum, preferably using a shop vacuum cleaner behind portions of the liner. About 3-4" of water is preferably added to the pool prior to removing the vacuum. The pool is then filled until the water level is approximately 2" below the level of the return line (or lights, if any). After attachment of the return face plate (and light face plates, if any), the water level is increased to 2" below the skimmer and the skimmer face plate is attached, with a gasket being placed between the skimmer plate and the liner. The pool is then filled until two-thirds of the skimmer face plate is under water. Installation of the lighting system, if any, and the filtration system is then completed. A coping clip is placed over all of the coping joints. A ladder, if any, is then installed. Finally, the liner is cut along the inner edges of the skimmer face plate, the return face plate, and any light face plates and removed.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of construction comprising the steps of:

a) mounting a threaded rod of a leveling gauge vertically in the ground, the leveling gauge comprising:

the threaded rod;

a pivot bracket having at least one opening and rotatably mounted on the threaded rod;

a horizontal board extending horizontally from the pivot bracket;

a level mounted on a top planar surface of the horizontal board; and at least one nut adjustably threadable on the threaded rod supporting the pivot bracket on the threaded rod such that the pivot bracket is horizontally pivotable around the threaded rod; and b) horizontally rotating the pivot bracket around the threaded rod while marking the ground at a dig radius distance from the threaded rod as measured using the horizontal board.

2. The method of claim 1 further comprising the steps of:

c) locating a high point within the area to be leveled by adjusting a height of the pivot bracket such that when pivoting the pivot bracket one rotation while maintaining a level reading of the level, the horizontal board contacts at only the high point within the area; and d) locating a low point within the area to be leveled by pivoting the pivot bracket while maintaining a level reading of the level until the low point with a maximum distance between the horizontal board and the ground within the area is determined.

3. The method of claim 2 further comprising the steps of:

e) removing any sod at the low point and leveling the area within a tolerance of an inch to a level of the low point by removal of material; and f) lowering the pivot bracket on the threaded rod until the horizontal board contacts at a high point within the area with a level reading of the level.

4. The method of claim 2 further comprising the step of:

g) locating a plurality of blocks within the area a predetermined distance (C) from the threaded rod on the horizontal board using the leveling gauge and a predetermined distance (B) apart from each other using a side-to-side gauge, a first block of the plurality of blocks being located at the high point determined in step f).

5. The method of claim 4 further comprising the steps of:

h) mounting a plurality of panels sequentially, each panel comprising:

a plurality of staves arranged side-by-side, each stave having upper and lower ends, inwardly and outwardly facing side major surfaces, and first and second opposing side edges extending between the major surfaces;

a top rail comprising a top stave-retaining portion that maintains the upper ends of the staves, a first top projecting portion extending from a first end of the panel, and a second top projecting portion extending from a second end of the panel opposite the first end; and a bottom rail comprising a bottom stave-retaining portion that supports the lower ends of the staves, a first bottom projecting portion extending from the first end of the panel, and a second bottom projecting portion extending from the second end of the panel;

the projecting portions of each panel being located on neighboring blocks, wherein the panels are arranged with respect to each other at predetermined angles; and i) positioning a leveling bolt on each block for fastening bottom projecting portions of neighboring panels using a panel positioning guide mounted at a predetermined distance (P) on the horizontal board; the panel positioning guide comprising a main portion mounted to the board by at least one fastener and a guide portion extending from the main portion and forming a u-shaped recess, the leveling bolt being successfully positioned when it fits in the u-shaped recess.

6. The method of claim 5 further comprising the step of:

j) leveling each panel by adjusting the height of at least one nut adjustably threaded on the leveling bolt on which the bottom projecting portions rest.

7. The method of claim 5 further comprising the step of:

k) cutting the horizontal board to a predetermined length (S), mounting a vertical board to a second end opposite the first end of the horizontal board, and mounting a side portion to the vertical board, the side portion extending upward from a side of the vertical board; and l) pivoting the pivot bracket around the threaded rod with the side portion sliding on a top surface of the panels, the lower planar surface of the horizontal board being at a predetermined position to smooth the surface of a layer of sand positioned underneath the horizontal board.

8. A method of construction comprising the steps of:

a) using a leveling gauge comprising a threaded rod mounted vertically in the ground, a pivot bracket rotatably mounted on the threaded rod, a horizontal board mounted in the pivot bracket, and a level mounted on a top planar surface of the horizontal board to measure a dig radius of an area to be leveled;

b) marking the ground at a dig radius distance from the threaded rod as measured using the horizontal board;

c) locating a high point within the area to be leveled by adjusting a height of the pivot bracket such that when pivoting the pivot bracket one rotation while maintaining a level reading of the level, the horizontal board contacts at only the high point within the area;

d) locating a low point within the area to be leveled by pivoting the pivot bracket while maintaining a level reading of the level until the low point with a maximum distance between the horizontal board and the ground within the area is determined;

e) removing any sod at the low point and leveling the area within a tolerance of an inch to a level of the low point by removal of material;

f) lowering the pivot bracket on the threaded rod until the horizontal board contacts at a high point within the area with a level reading of the level;

g) locating a plurality of blocks within the area a predetermined distance (C) from the threaded rod on the horizontal board using the leveling gauge and a predetermined distance (B) apart from each other using a side-to-side gauge, a first block of the plurality of blocks being located at the high point determined in step f);

h) mounting a plurality of panels sequentially, each panel comprising:

a plurality of staves arranged side-by-side, each stave having upper and lower ends, inwardly and outwardly facing side major surfaces, and first and second opposing side edges extending between the major surfaces;

a top rail comprising a top stave-retaining portion that maintains the upper ends of the staves, a first top projecting portion extending from a first end of the panel, and a second top projecting portion extending from a second end of the panel opposite the first end; and a bottom rail comprising a bottom stave-retaining portion that supports the lower ends of the staves, a first bottom projecting portion extending from the first end of the panel, and a second bottom projecting portion extending from the second end of the panel;

the projecting portions of each panel being located on neighboring blocks, wherein the panels are arranged with respect to each other at predetermined angles; and i) positioning a leveling bolt on each block for fastening bottom projecting portions of neighboring panels using a panel positioning guide mounted at a predetermined distance (P) on the horizontal board; the panel positioning guide comprising a main portion mounted to the board by at least one fastener and a guide portion extending from the main portion and forming a u-shaped recess, the leveling bolt being successfully positioned when it fits in the u-shaped recess.

9. The method of claim 8 further comprising the step of:

j) leveling each panel by adjusting the height of at least one nut adjustably threaded on the leveling bolt on which the bottom projecting portions rest.

10. The method of claim 8 further comprising the step of:

k) cutting the horizontal board to a predetermined length (S), mounting a vertical board to a second end opposite the first end of the horizontal board, and mounting a side portion to the vertical board, the side portion extending upward from a side of the vertical board; and

1) pivoting the pivot bracket around the threaded rod with the side portion sliding on a top surface of the panels, the lower planar surface of the horizontal board being at a predetermined position to smooth the surface of a layer of sand positioned underneath the horizontal board.

11. A method of construction comprising the steps of:

a) marking a dig radius on the ground of an area to be leveled;

b) removing any sod at a low point within the area;

c) leveling the area within a tolerance of an inch to a level of the low point by removal of material;

d) locating a plurality of blocks around the area; and e) mounting a plurality of panels sequentially on the blocks, each panel comprising:

a plurality of staves arranged side-by-side, each stave having upper and lower ends, inwardly and outwardly facing side major surfaces, and first and second opposing side edges extending between the major surfaces;

a top rail comprising a top stave-retaining portion that maintains the upper ends of the staves, a first top projecting portion extending from a first end of the panel, and a second top projecting portion extending from a second end of the panel opposite the first end; and a bottom rail comprising a bottom stave-retaining portion that supports the lower ends of the staves, a first bottom projecting portion extending from the first end of the panel, and a second bottom projecting portion extending from the second end of the panel;

the projecting portions of each panel being located on neighboring blocks, wherein the panels are arranged with respect to each other at predetermined angles.

12. The method of claim 11, wherein step a) comprises the sub-steps of:

using a leveling gauge comprising a threaded rod mounted vertically in the ground, a pivot bracket rotatably mounted on the threaded rod, a horizontal board mounted in the pivot bracket, and a level mounted on a top planar surface of the horizontal board to measure a dig radius of an area to be leveled; and marking the ground at a dig radius distance from the threaded rod as measured using the horizontal board.

13. The method of claim 11, wherein step b) comprises the sub-steps of:

locating a high point within the area to be leveled by adjusting a height of the pivot bracket such that when pivoting the pivot bracket one rotation while maintaining a level reading of the level, the horizontal board contacts at only the high point within the area; and locating a low point within the area to be leveled by pivoting the pivot bracket while maintaining a level reading of the level until the low point with a maximum distance between the horizontal board and the ground within the area is determined.

14. The method of claim 11, wherein step d) comprises the sub-steps of:

A) lowering the pivot bracket on the threaded rod until the horizontal board contacts at a high point within the area with a level reading of the level; and B) locating a plurality of blocks within the area a predetermined distance (C) from the threaded rod on the horizontal board using the leveling gauge and a predetermined distance (B) apart from each other using a side-to-side gauge, a first block of the plurality of blocks being located at the high point determined in sub-step A).

15. The method of claim 11, wherein step e) further comprises the sub-step of:

positioning a leveling bolt on each block for fastening bottom projecting portions of neighboring panels using a panel positioning guide mounted at a predetermined distance (P) on the horizontal board; the panel positioning guide comprising a main portion mounted to the board by at least one fastener and a guide portion extending from the main portion and forming a u-shaped recess, the leveling bolt being successfully positioned when it fits in the u-shaped recess.

16. The method of claim 15 further comprising the step of:

f) leveling each panel by adjusting the height of at least one nut adjustably threaded on the leveling bolt on which the bottom projecting portions rest.

17. The method of claim 16 further comprising the steps of:

g) cutting the horizontal board to a predetermined length (S), mounting a vertical board to a second end opposite the first end of the horizontal board, and mounting a side portion to the vertical board, the side portion extending upward from a side of the vertical board; and h) pivoting the pivot bracket around the threaded rod with the side portion sliding on a top surface of the panels, the lower planar surface of the horizontal board being at a predetermined position to smooth the surface of a layer of sand positioned underneath the horizontal board.

* * * * *